US010233912B2

(12) United States Patent
Chabert et al.

(10) Patent No.: US 10,233,912 B2
(45) Date of Patent: Mar. 19, 2019

(54) ELECTRONEGATIVE PLASMA THRUSTER WITH OPTIMIZED INJECTION

(75) Inventors: Pascal Chabert, Paris (FR); Ane Aanesland, Paris (FR); Albert Meige, Paris (FR); Gary Leray, Gentilly (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 465 days.

(21) Appl. No.: 13/131,366

(22) PCT Filed: Nov. 24, 2009

(86) PCT No.: PCT/EP2009/065688
§ 371 (c)(1),
(2), (4) Date: May 26, 2011

(87) PCT Pub. No.: WO2010/060887
PCT Pub. Date: Jun. 3, 2010

(65) Prior Publication Data

US 2011/0232261 A1 Sep. 29, 2011

(30) Foreign Application Priority Data

Nov. 28, 2008 (FR) ..... 08 58077

(51) Int. Cl.
*F03H 1/00* (2006.01)
*H05H 1/54* (2006.01)

(52) U.S. Cl.
CPC ..... *F03H 1/0025* (2013.01); *F03H 1/0012* (2013.01); *H05H 1/54* (2013.01)

(58) Field of Classification Search
CPC ..... F03H 1/00; F03H 1/0006; F03H 1/0037; F03H 1/0025; F03H 1/0012;
(Continued)

(56) References Cited

U.S. PATENT DOCUMENTS 2,819,423 A * 1/1958 Clark ..... G01M 9/04 219/121.11
2,975,375 A * 3/1961 Goldstein ..... 331/78
(Continued)

FOREIGN PATENT DOCUMENTS

FR 2894301 A1 6/2007
JP 62174573 A * 7/1987 ..... F03H 1/00

OTHER PUBLICATIONS

Burton et al., Pulsed Plasma Thruster, Oct. 1998, Journal of Propulsion and Power, vol. 14, pp. 1-20.*
(Continued)

*Primary Examiner* — Gerald L Sung
*Assistant Examiner* — William Breazeal
(74) *Attorney, Agent, or Firm* — Baker & Hostetler LLP

(57) ABSTRACT

A plasma thruster includes extraction of a stream of positive ions. The plasma thruster includes a single ionization stage; injecting ionizable gas for said ionization stage comprising injecting a first gas and an electronegative second gas; creating an RF electric field to cause the gases to ionize in the ionization stage creating a first zone called the hot zone, in the ionization stage; the first gas being distributed in the hot first zone, the second gas being distributed in a second zone less hot than said first zone; extracting a stream of negative ions and a stream of positive ions, these being both connected to the ionization stage; and the extraction of a stream of positive ions and the extraction of a stream of negative ions, ensuring that the thruster is electrically neutral.

18 Claims, 5 Drawing Sheets

(58) Field of Classification Search
CPC .... F03H 1/0043; F02H 1/0012; F02H 1/0056; F02H 1/0037; F02H 1/0081; H05H 1/54
USPC ..... 60/202, 204
See application file for complete search history.

(56) References Cited

U.S. PATENT DOCUMENTS

| | | | | |
|---|---|---|---|---|
| 6,573,510 | B1 | 6/2003 | Vella | |
| 6,806,651 | B1 * | 10/2004 | Chistyakov | 315/111.21 |
| 7,095,179 | B2 * | 8/2006 | Chistyakov | 315/111.21 |
| 2004/0251123 | A1 | 12/2004 | Ohkawa | |
| 2006/0030134 | A1 | 2/2006 | Kim et al. | |
| 2008/0271430 | A1 | 11/2008 | Chabert | |
| 2009/0084501 | A1 * | 4/2009 | Chen et al. | 156/345.26 |

OTHER PUBLICATIONS

Sudit Discharge equilibrium of a helicon plasma 1995.*
Celik Spectral Measurements of mHTX Helicon Discharge Plasma 2007.*
Economou, "Fundamentals and applications of ion-ion plasmas," Applied Surface Science, vol. 253, (2007), 6672-6680, Elsevier, Amsterdam, NL, XP022078819.

* cited by examiner

ELECTRONEGATIVE PLASMA THRUSTER WITH OPTIMIZED INJECTION

CROSS-REFERENCE TO RELATED APPLICATIONS

This application is a National Stage of International patent application PCT/EP2009/065688, filed on Nov. 24, 2009, which claims priority to foreign French patent application No. FR 08 58077, filed on Nov. 28, 2008, the disclosures of which are incorporated by reference in their entirety.

FIELD OF THE INVENTION

The invention relates to the field of plasma thrusters. These thrusters may for example be used in satellites or else in spacecraft, the propulsion of which requires low thrust levels over long periods of time, such as for example probes.

BACKGROUND OF THE INVENTION

The propulsion of craft in space (where the Earth's gravitation becomes negligible) requires low thrust levels (small stream of ejected matter) but high ejection velocities of the "fuel" in order to minimize the onboard mass. Specifically, the increase in velocity of a spacecraft is related to the gas ejection velocity $u_e$ and to the initial mass of fuel $M_0$ and the final mass of fuel $m_f$ by the following equation, called the "rocket equation":

$$\Delta u = u_e \ln\left(\frac{m_0}{m_f}\right).$$

A high gas ejection velocity is therefore imperative if it is desired to save fuel. Plasma thrusters allow these high ejection velocities to be achieved. Two quantities are used to characterize a thruster, namely the specific impulse:

$$I_s = \frac{u_e}{g_o}$$

expressed in seconds, where $g_o$ is the gravitational constant at the Earth's surface, and the thrust:

$$T = \dot{m} u_e$$

where $\dot{m}$ is the mass flow rate.

The classical principle of plasma thrusters depicted in the diagram illustrated in FIG. 1 is as follows: the "fuel" (gas) X is firstly ionized to form positive ions $X^+$ and electrons $e^-$. The positive ions are accelerated by an electric field E, created by accelerating grids, and are thus ejected from the system before being neutralized by an ancillary beam of electrons $Fe^-$, this being positioned downstream of the accelerating zone and generated by a cathode. Neutralization is essential in order to prevent spacecraft from becoming electrically charged.

Various plasma thruster prototypes existing at the present time use in general an ionization stage to generate a source of positively charged matter (positive ions), an acceleration stage and a neutralization structure. The ionization sources and accelerating or neutralizing structures may vary. However, all thrusters currently existing use only the positively charged matter (positive ions) for the propulsion, the negative charges (electrons) serving only for ionization and for neutralization.

In this context, the Applicant has already proposed, in a prior French patent application published under the number 2 894 301, to use a stream of positive ions and a stream of negative ions for the thrust. To do this, an electronegative gas (a gas having a high electron affinity) is used as fuel. It may be used in combination with an electropositive gas; in this case, the two gases are different and there are two separate ion sources, or else it may be used by itself and, in the latter case, the stream of negative ions and the stream of positive ions are generated from this same electronegative gas.

FIG. 2 illustrates this type of thruster configuration. More precisely, the thruster comprises a structure supplied with electronegative gas and:

an ionization stage 1;

a filtration stage 2; and an extraction stage 3.

A stream of electronegative gas $A_2$ is injected into the ionization stage 1. Through the action of electrical power shown schematically by the arrow Pe, the electronegative gas generates positive ions $A^+$, negative ions $A^-$ and electrons $e^-$. The ionization stage 1 is coupled to a filtration stage 2 for filtering the electrons so as to have, in the extraction stage 3, a plasma of positive ions and negative ions containing no electrons.

The filtration means may for example be a static magnetic field. In the case depicted schematically here, the plasma is extracted by two grids, namely a negatively biased grid 4 and a positively biased grid 5, according to a first possible method of extraction.

The plasma may also be extracted by a grid biased alternately positively and negatively according to a second method of extraction. The first and second methods of extraction may also be combined or arranged in the form of a matrix (for example to increase the size of the system).

The thrust is therefore provided by the two types of ions (negative charges and positive charges). Downstream neutralization is no longer necessary since the ion beams become neutralized downstream (by recombination) to form a beam of rapidly moving neutral molecules.

The plasma thruster has a single ionization stage within which a plasma of positive ions and negative ions is created.

SUMMARY OF THE INVENTION

To improve such a thruster, the Applicant proposes to exploit the difference in temperature of the electrons within the ionization stage: "hot" electrons are conducive to the positive ionization of the electronegative gas, and therefore create positive ions, whereas the "less hot" electrons are conducive to the creation of negative ions, by attachment of these electrons.

Optimization of this type of thruster is thus based notably on the optimized injection of the electronegative gas within the ionization stage.

More precisely, the subject of the present invention is a plasma thruster comprising extraction of a stream of positive ions, characterized in that it comprises:

a single ionization stage;

means for injecting ionizable gas for said ionization stage, said means comprising at least first means for injecting a first gas and second means for injecting an electronegative second gas;

means for creating electrical power so as to cause the gases to ionize in the ionization stage, said means creating a first zone called the hot zone, in the ionization stage;

the first gas being distributed in the hot first zone, the second gas being distributed in a second zone less hot than said first zone;

first means for extracting a stream of negative ions and second means for extracting a stream of positive ions, these being both connected to the ionization stage; and the extraction of a stream of positive ions and the extraction of a stream of negative ions, ensuring that the thruster is electrically neutral.

According to one embodiment of the invention, the first gas and the second gas are identical.

According to one embodiment of the invention, the thruster has two compartments, constituents of the first and second zones.

According to one embodiment of the invention, the first means for injecting the first gas are located on a first face of the ionization stage, the second injection means being distributed along a second face transverse to said first face so as to deliver a series of second gas streams into the ionization stage.

According to one embodiment of the invention, the second means for injecting the second gas deliver streams of different flow rates into the ionization stage.

According to one embodiment of the invention, it further includes means for filtering the electrons liberated in the ionization stage during ionization of the gas.

According to one embodiment of the invention, the means for creating an electric field comprise two conductive elements placed at the ends of the ionization stage in order to put said stage under voltage.

According to one embodiment of the invention, the means for creating an electric field comprise a coil 31 supplied by a radiofrequency current.

According to one embodiment of the invention, the means for creating an electric field comprise a helicon antenna supplied by a radiofrequency (RF) current.

According to one embodiment of the invention, the electronegative gas is a dihalogen.

According to one embodiment of the invention, the electronegative gas is of the diiodide type.

According to one embodiment of the invention, the electronegative gas is oxygen.

According to one embodiment of the invention, the electronegative gas is sulfur hexafluoride ($SF_6$).

According to one embodiment of the invention, the thruster comprises means for creating a pulsed plasma.

According to one embodiment of the invention, the thruster comprises means for generating a static magnetic field within the ionization stage, so as to filter the electrons.

According to one embodiment of the invention, the thruster comprises permanent magnets 33 placed on the periphery of the ionization stage in order to create the magnetic field within said ionization stage.

According to one embodiment of the invention, the thruster comprises means for extracting streams of negative and/or positive ions in a direction perpendicular to the direction of the magnetic field applied in the ionization stage.

According to one embodiment of the invention, the thruster includes a system for the temporal modulation of the ion extraction means.

According to one embodiment of the invention, the positive and negative ions are extracted alternately by the same extraction means.

According to one embodiment of the invention, the ion stream extraction means comprise at least one biased grid.

BRIEF DESCRIPTION OF THE DRAWINGS

The invention will be better understood and further details will become apparent on reading the following description given by way of nonlimiting example and in conjunction with the appended figures in which.

DETAILED DESCRIPTION

In general, the thruster of the invention comprises a single ionization stage coupled to means for ionizing one or more gases intended for the thrust, said stage comprising at least first means 32 for injecting a first gas and second means 32 for injecting a second gas. The second gas injected is an electronegative gas and is diffused into the ionization stage in a cooler region compared with a hot zone located close to the means for creating an electric field necessary for ionizing the gases.

These means for coupling the electrical energy into the plasma may be of the type comprising two DC, low-frequency or radiofrequency biased plates, a coil fed with radiofrequency power for inductive coupling, or else a microwave source. According to one embodiment of the invention, the means for creating an electric field comprise two conductive elements 304, 306 placed at the ends of the ionization stage in order to put said stage under voltage.

Figure 3:
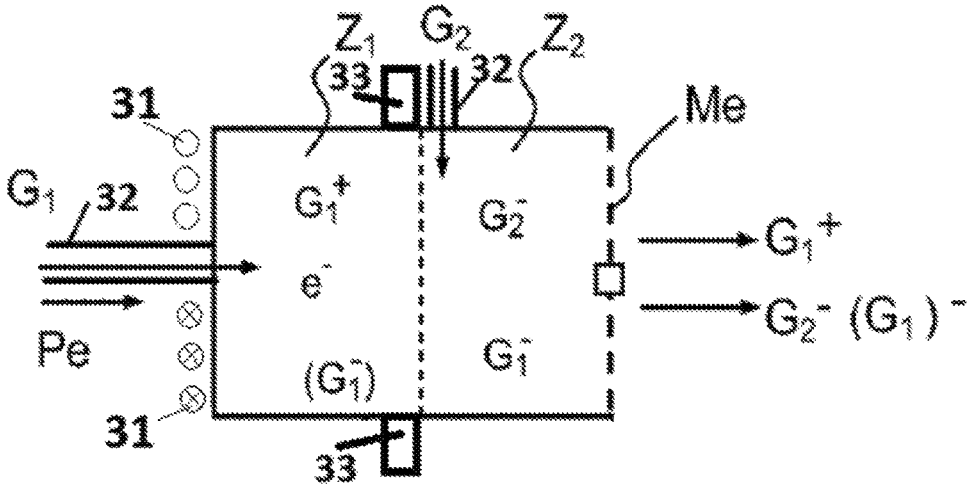
FIG. 3 illustrates an example of a thruster according to the invention, comprising the injection of two different gases at separate and optimized locations.

FIG. 3 shows schematically a first example of an ionization stage comprising a feed with gas $G_1$ and a feed with electronegative gas $G_2$, the electrical energy coupling means being represented by a supply power Pe and generating electrons represented by $e^-$.

The hot region of the ionization stage is referenced $Z_1$ close to the RF source, while the cooler region away from the RF source is referenced $Z_2$. According to the invention, the electronegative gas is injected into the less-hot region.

More precisely, the first gas may be an electropositive or electronegative gas, injected into the hot region $Z_1$ within the core of the plasma in which the RF power is coupled with the electrons.

The efficient generation of positive ions ($G_1^+$) and negative ions ($G_1^-$) (using an electronegative gas) starting from the gas $G_1$ is carried out in this region $Z_1$.

The second gas is injected into a region $Z_2$ close to the extraction means, in which region the electrons have a lower temperature. The second gas is chosen to be electronegative, ensuring efficient generation of negative ions ($G_2^-$).

Extraction means Me, for example, at least one biased grid, are provided for extracting the positive ions and the negative ions. According to one embodiment of the invention, the thruster includes a system for the temporal modulation 302 of the ion extraction means.

Figure 4:
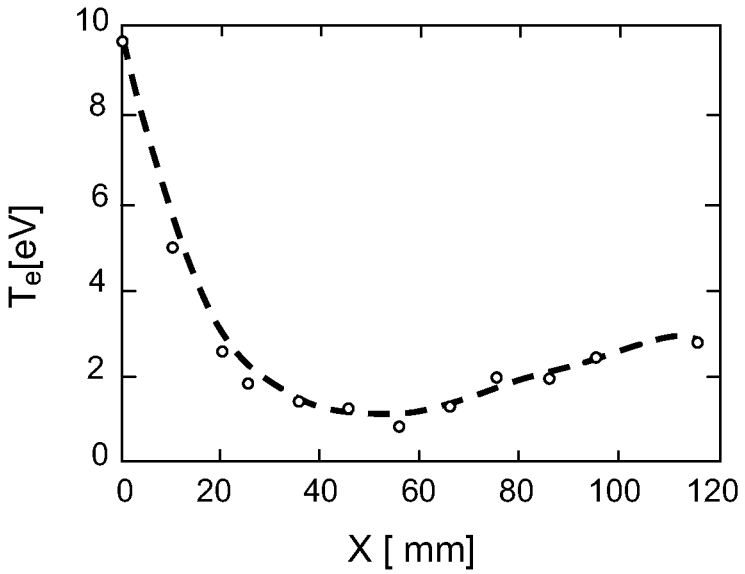
FIG. 4 illustrates the variation in the electron temperature as a function of the distance from means for creating an electric field perpendicular to an applied magnetic field creating an electron heating zone.

FIG. 4 illustrates in this case the variation in the electron temperature ($T_e$) as a function of a distance X within the ionization stage, the distance being measured from the zone located near the point of electric field creation (reference 0) plotted on the horizontal axis in said FIG. 4.

Figure 5:
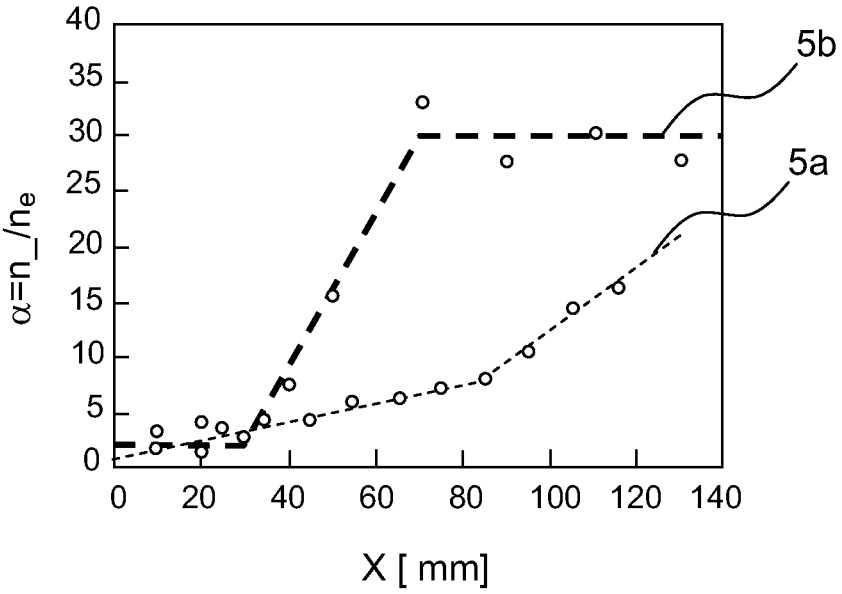
FIG. 5 illustrates the variation in the ratio of negative ions per electron, generated by attachment collision, as a function of the distance from means for creating an electric field perpendicular to an applied magnetic field creating an electron heating zone.

FIG. 5 illustrates the variation of the ratio ($\alpha$) of negative ions per electron as a function of the same distance X. It is apparent that the generation of negative ions is very pronounced beyond a distance of about 40 mm in the case considered. Curve 5*a* relates to an $O_2$ gas while curve 5*b* relates to an $SF_6$ gas.

Moreover, the rate of creation of negative ions is a decreasing function of the electron temperature, whereas the rate of ionization, creating positive ions, by collision with electrons, is an exponential function of the electron temperature.

Figure 6:
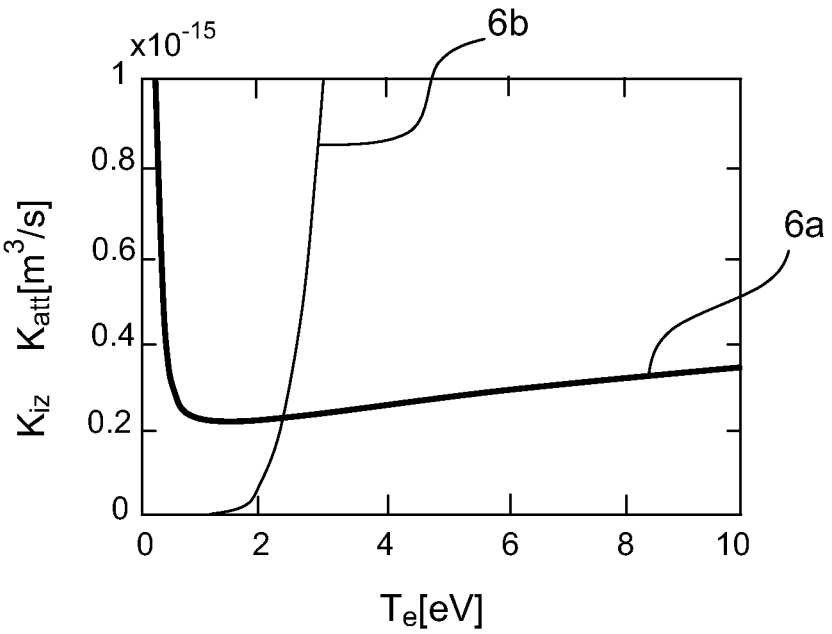
FIG. 6 illustrates the level of negative ion generation by collision with electrons (attachment) as a function of the temperature and the level of ionization creating positive ions by collision with electrons as a function of the temperature.

FIG. 6 illustrates this behavior for an electronegative gas, curve 6*a* relating to the first phenomenon $K_{att}$ (attachment reaction) and curve 6*b* relating to the second phenomenon $K_{iz}$ (ionization reaction) respectively.

These two processes interfere for electron temperatures between 2 and 4 eV, depending on the gases. The negative ions are created in the low-temperature region and become dominant when the electron temperature is typically less than 1-2 eV, whereas the positive ions are created in a region of high electron temperature and become dominant for energies above about 4-5 eV (the threshold values vary greatly depending on the type of gas).

The electronegative gas used may advantageously be a dihalogen of the $I_2$ type. Such a gas has a number of advantages—it is inexpensive compared with other electronegative gases and has the great advantage of being solid at room temperature, thereby greatly simplifying all the packaging and storage processes.

It is also highly electronegative and its ionization threshold is relatively low—it may thus generate not only negative ions but also positive ions very efficiently. It may also be used in a thruster according to the invention just as effectively both as first gas $G_1$ and as second gas $G_2$.

According to one embodiment of the invention, the thruster may use as first gas a gas of the xenon type, for generating positive ions, and as second gas a dihalogen capable of generating negative ions.

In the above embodiments of the invention, the thruster comprises two zones, called hot and cold zones respectively, into which a first gas and an electronegative second gas are respectively injected via two injection means.

Figure 7:
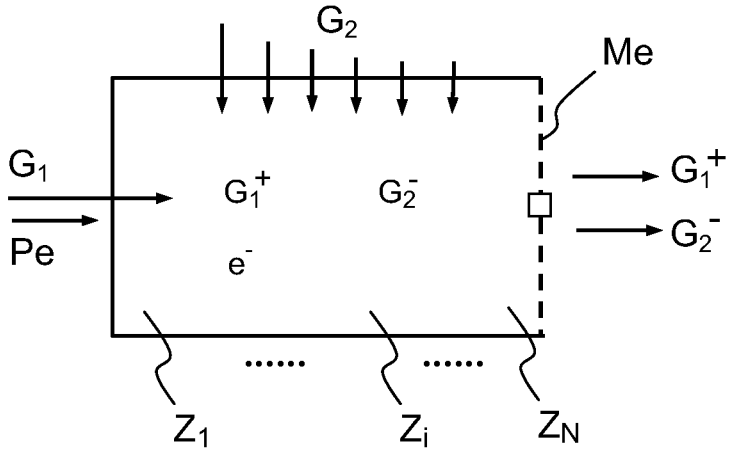
FIG. 7 shows schematically a second embodiment of the invention comprising a series of means for injecting the second gas into the ionization stage.

According to another, more elaborate, embodiment of the invention, it is proposed to use a series of means for injecting the second gas, with injection flow rates that may be optimized according to the variation in the temperature in the ionization stage and therefore as a function of the electron temperature. These injections are thus carried out in a series of regions $Z_1, \ldots, Z_i, \ldots, Z_N$ with variable flow rates. This embodiment shown schematically in FIG. 7 relates to an example in which the single electronegative gas $I_2$ is injected so as to generate both positive ions and negative ions.

In these various embodiments, the thrust is therefore provided by the two types of ion (positive ions and negative ions). Neutralization downstream is no longer necessary since the ion beams are neutralized downstream (by recombination) to form a beam of rapidly moving neutral molecules.

Figure 1:
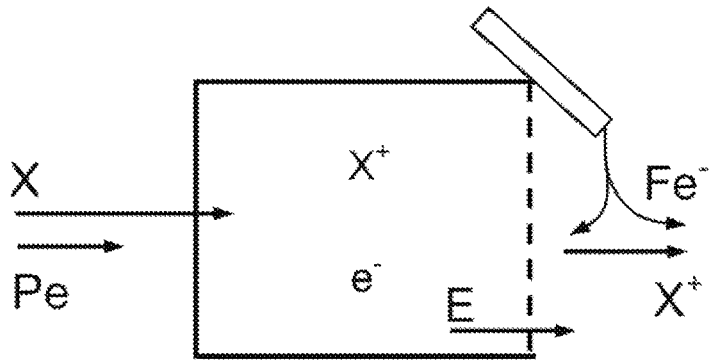
FIG. 1 shows schematically a conventional plasma thruster according to the prior art, comprising an electropositive gas for generating a stream of positive ions, which is neutralized with an electron beam downstream of the accelerating zone.
Figure 2:
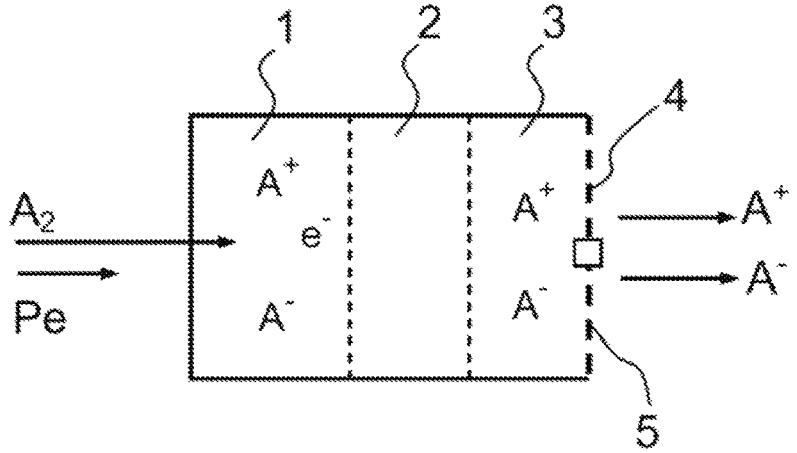
FIG. 2 shows schematically a plasma thruster according to the prior art comprising an electronegative gas for simultaneously generating a stream of positive ions and a stream of negative ions.

As is known, the ionization stage described above may be coupled to a filtration stage, such as that illustrated in FIG. 2.

The filtration stage may be produced in at least two ways:

(i) by modulating the creation of the plasma (pulsed plasmas: ON-OFF alternation of the electric power) and using the OFF period for the extraction, during which period the electrons disappear by attachment on the molecules. According to this configuration, the ionization stage and the filtration stage are common;

(ii) using a static magnetic field to trap the electrons, the much heavier ions not being trapped.

The thruster of the invention also includes an extraction stage that may be formed from accelerating grids, the dimensions of which are not necessarily similar to those in thrusters having a conventional grid, since the properties of the space charge sheaths are different in the absence of electrons.

Figure 8A:
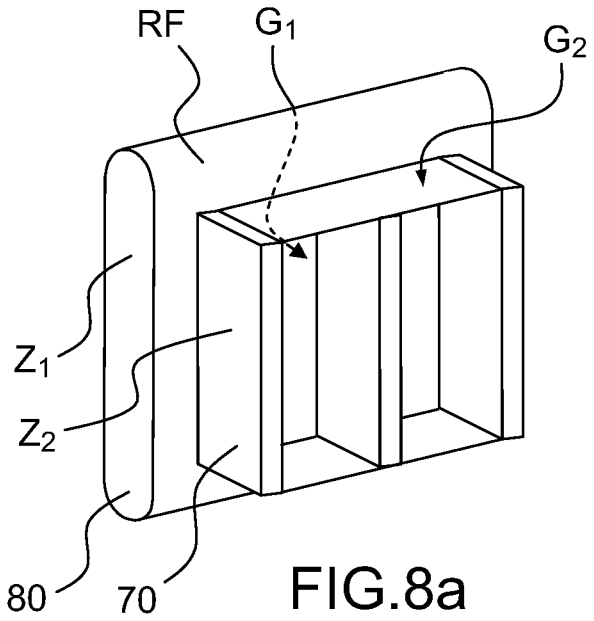
FIGS. 8*a*, 8*b* and 8*c* illustrate an example of a thruster according to the invention.
Figure 8B:
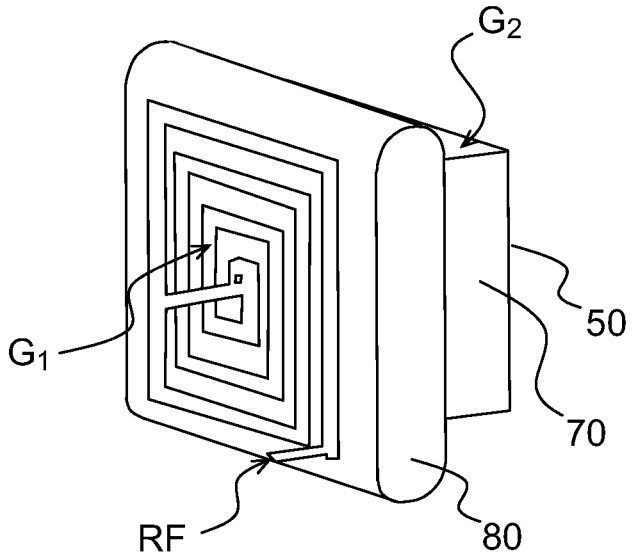

Example of a Thruster According to the Invention:

In this example of a thruster according to the invention, the plasma is created by an RF (radiofrequency) antenna, the active surface of which is optimized and designed according to the intended applications. FIGS. 8*a* and 8*b* illustrate different views of the RF antenna and two zones, called the hot zone $Z_1$ and the cold zone $Z_2$ into which the gases $G_1$ and $G_2$ are injected respectively.

A plate 80 seals the enclosure into which the gas $G_1$ is injected.

The temperature in the volume $Z_1$ is high enough for creating positive ions by ionization and thus obtaining a high density of positive ions in this region.

An electronegative second gas $G_2$ is injected into the volume $Z_2$ in order to produce the negative ions.

The extraction volume is divided into two regions by permanent magnets, two accelerating grids being also installed at the outlet of the volume $Z_2$.

Permanent magnets 70 are placed on one face and in the middle of the volume $Z_2$ in order to filter the electrons so as to preserve in the medium only positive ions and negative ions at the outlet of the volume $Z_2$. In this region, the electron temperature decreases and the negative ions are produced by attachment collision with electrons. The applied magnetic field has two functions:

(i) to increase the ionization efficiency by better confinement of the electrons; and (ii) to create the magnetic filter for the electrons, i.e. to "magnetize" the electrons, in order to prevent them from diffusing towards the extraction means.

Figure 8C:
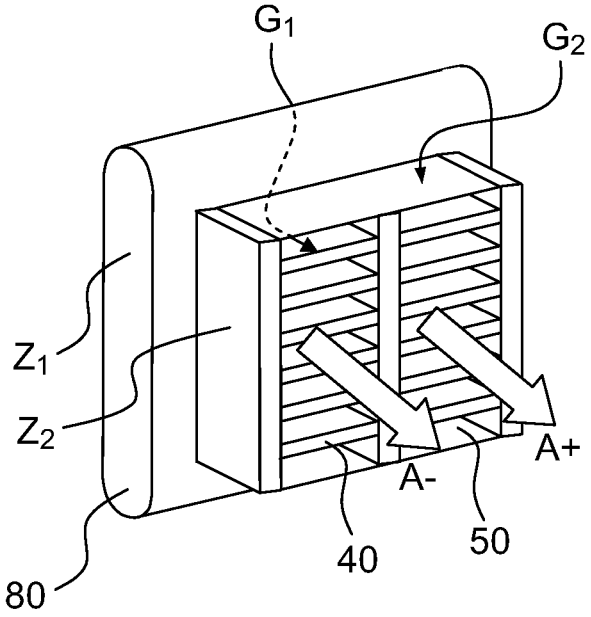

Extraction means 40 and 50 shown in FIG. 8*c* are used to accelerate the ions and expel them from the thruster, the ionic entities $A^-$ and $A^+$ thus being extracted from the thruster.

These means may typically be of the grid type, one grid being able to be used to accelerate the negative ions and another grid being able to be used to accelerate the positive ions.

It is also possible to introduce only a single grid, biased alternately so as to extract negative ions alternately with positive ions. It is also conceivable to use an array of grids.

Finally, the two ion beams extracted, of opposite signs, become neutralized downstream (in space). The neutralization is therefore automatic and does not require an additional electron beam. The two beams may also recombine to form a beam of rapidly moving neutral molecules.

The invention claimed is:

1. A plasma thruster for extraction of a stream of positive ions, the plasma thruster comprising:

a single ionization stage;

means configured for injecting ionizable gas for said ionization stage, said means configured for injecting comprising at least a first means for injecting a first gas and a second means configured for injecting an electronegative second gas;

means for creating a radio frequency (RF) electric field to cause the first gas and the second electronegative gas to ionize in the single ionization stage, said means for creating configured to create a first zone, said first zone being a hot zone, in the single ionization stage, the first gas being distributed in the hot zone, the electronegative second gas being distributed in a second zone of said ionization stage, said second zone being less hot than said first zone; and at least one means for extracting a stream of negative ions and for extracting a stream of positive ions, the at least one means for extracting the stream of negative ions and the stream of positive ions being connected to the single ionization stage, and ensuring that the plasma thruster is electrically neutral.

2. The plasma thruster according to claim 1, wherein the first gas and the electronegative second gas are identical.

3. The plasma thruster according to claim 1, further comprising: two compartments, the two compartments being constituents of the first zone and second zone.

4. The plasma thruster according to claim 1, wherein the first means for injecting the first gas are located on a first face of the single ionization stage, the second means for injecting the electronegative second gas being distributed along a second face transverse to said first face so as to deliver a series of electronegative second gas streams into the single ionization stage.

5. The plasma thruster claimed in according to claim 4, wherein the second means for injecting the electronegative second gas deliver streams of different flow rates into the single ionization stage.

6. The plasma thruster according to claim 1, wherein the at least one means for extracting the stream of negative ions and the stream of positive ions comprises at least one grid, biased alternately to extract negative ions alternately with positive ions.

7. The plasma thruster according to claim 1, wherein the means for creating the RF electric field comprise two conductive elements placed at ends of the ionization stage in order to put said stage under voltage.

8. The plasma thruster according to claim 1, wherein the means for creating the RF electric field comprise a coil supplied by a radiofrequency current.

9. The plasma thruster according to claim 1, wherein the means for creating the RF electric field comprise a helicon antenna supplied by a radiofrequency (RF) current.

10. The plasma thruster according to claim 1, wherein the electronegative second gas is a dihalogen.

11. The plasma thruster according to claim 10, wherein the electronegative second gas is of the diiodide type.

12. The plasma thruster according to claim 1, wherein the electronegative second gas is $SF_6$.

13. The plasma thruster according to claim 1, wherein the electronegative second gas is oxygen.

14. The plasma thruster according to claim 5, further comprising:

means for generating a static magnetic field within the ionization stage so as to filter electrons.

15. The plasma thruster according to claim 14:

wherein the means for generating a static magnetic field within the ionization stage comprises permanent magnets placed on the periphery of the ionization stage in order to create the magnetic field within said ionization stage.

16. The plasma thruster according to claim 14, wherein said at least one means for extracting the stream of negative ions and the stream of positive ions are configured to extract the stream of negative ions and the stream of positive ions in a first direction perpendicular to a first direction of the static magnetic field applied in the ionization stage.

17. The plasma thruster according to claim 1, wherein said at least one means for extracting a stream of negative ions and a stream of positive ions comprises a first means for extracting negative ions and a second means for extracting positive ions, the first means for extracting a stream of negative ions and the second means for extracting the positive ions being connected to the ionization stage.

18. The plasma thruster according to claim 17, wherein the first means for extracting a stream of negative ions is a grid and the second means for extracting a stream of positive ions is another grid.

* * * * *